US008082914B2

(12) United States Patent
Ip

(10) Patent No.: US 8,082,914 B2
(45) Date of Patent: Dec. 27, 2011

(54) PORTABLE AND EASY-TO-CLEAN KITCHEN STOVE

(76) Inventor: Joseph Chi Tak Ip, DongGuan (CN)

( * ) Notice: Subject to any disclaimer, the term of this patent is extended or adjusted under 35 U.S.C. 154(b) by 410 days.

(21) Appl. No.: 12/430,587

(22) Filed: Apr. 27, 2009

(65) Prior Publication Data

US 2009/0205639 A1 Aug. 20, 2009

(51) Int. Cl.
*F24C 1/16* (2006.01)

(52) U.S. Cl. ..... 126/9 R; 126/39 E; 126/9 B; 126/40

(58) Field of Classification Search ..... 126/9 R, 126/39 E, 9 B, 40, 30, 50
See application file for complete search history.

(56) References Cited

U.S. PATENT DOCUMENTS 4,426,990 A * 1/1984 Shepherd ..... 126/9 B
5,906,196 A * 5/1999 Measom ..... 126/304 A

* cited by examiner

*Primary Examiner* — Alfred Basichas

(57) ABSTRACT

A portable and easy-to-clean kitchen stove includes a tabletop and supports, the tabletop being provided thereon with circular burner openings, beneath which burners are installed as well as chimney-shaped thermo-protective devices and pan adapters are arranged in turn, the burner openings being circumferentially welded with baffle rings, the tabletop being fixedly connected at the edge thereof with rims and flexibly connected at the edge thereof with a shield in turn, a drainage being disposed in front of the burner openings, the ends thereof being provided with a separator, a platen being disposed between the drainage and the front edge of the tabletop, beneath which sockets for assembling and disassembling the supports are arranged. This enables the kitchen stove to be simply structured, foldably carried, sanitary, quickly assembled and suitable for use at home and outdoors.

13 Claims, 16 Drawing Sheets

PORTABLE AND EASY-TO-CLEAN KITCHEN STOVE

BACKGROUND OF THE INVENTION (a) Field of the Invention

The present invention relates to a cooking tool used in a kitchen, and more particularly to a portable and easy-to-clean kitchen stove suitable for use at home and outdoors.

(b) Description of the Prior Art

Nowadays, kitchen stoves used in real life cooking are uneasily cleaned and inconveniently portable so there is no stove for cooking outdoors. Therefore, an easy-to-clean and portable kitchen stove is expected.

SUMMARY OF THE INVENTION

In the light of the foresaid shortcomings of the existing technology, the present invention aims to provide an easy-to-clean and portable kitchen stove.

The technical solution that the present invention utilizes to solve the technical problems is:

A portable and easy-to-clean kitchen stove including a single burner kitchen stove and a double burner kitchen stove that includes in its structure a tabletop and supports, the tabletop being provided thereon with circular burner openings, burners being installed at the bottommost of the burner openings, chimney-shaped thermo-protective devices and pan adapters being arranged above the burners in turn, the burner openings being circumferentially welded with baffle rings, the baffle rings being provided therein with stove rings, the pan adapters being arranged above the stove rings, a circular cover detachably covering the baffle ring, the rear, left and right edges of the tabletop being fixedly connected with rims and flexibly connected with a shield from the outside to the inside thereof in turn, a drainage being disposed in front of the burner openings on the tabletop, the end of the drainage being provided with a separator, a platen being disposed between the drainage and the front edge of the tabletop, sockets for assembling and disassembling the supports being arranged beneath the tabletop, and one side of the tabletop being provided with an armrest.

The aperture diameter of said chimney-shaped thermo-protective device installed above the burner is less than that of the burner opening, its bottom being horizontally aligned with the burner, 80% of its top portion being of concavo-convex design, 20% of its top portion being sealed, its top portion being of the same height as the baffle ring but the concavo-convex portion being higher than the baffle ring.

Said pan adapter includes a supporting ring, three legs being uniformly arranged around the circumference of the supporting ring. One surface of the leg is a plane surface and the other surface thereof is a beveled surface. The beveled surfaces are used for round-bottom woks and the plane surfaces are used for flat bottom pans. A raised firescreen is further provided on the supporting ring. A positioning groove is provided on the circumference of the stove ring. The pan adapter is caught and fixed in the positioning groove of the stove ring through the legs.

A circular cover detachably covers said baffle ring, and the circular cover fits the burner opening.

Said shield is comprised of a left and a right shield, a rear shield and two steel angles, the left and the right shield being connected to the left and the right side of the rear shield by hinges, the left and the right shield being inwardly rotatable so as to overlap the rear shield; the bottom of the rear shield being fastened to the rim at the rear by hinges, the rear shield being forwardly rotatable so as to be superposed on the left and the right shield and be placed on the tabletop, the two sides of the rear shield each having one steel angle, the rear shield and the steel angles being of integral construction or being welded; said rear shield being detachably snap-fitted with an extended steel face, the extended steel face being bilaterally fixedly provided thereon with bearing bolts that match the bearing sleeves disposed on the rear shield; the extended steel face being hangable on the hooks of the lower portion of the rim at the rear by the bearing sleeves.

Said separator is divided into a detachable waste collection box and a sewage treatment system, the detachable waste collection box being a box with many small apertures and fully open on the top side, the sewage treatment system being a rectangular box connected to the end of the drainage, its bottom being provided with a circular opening connected with a round stainless steel tube, the round steel tube being provided thereon with threads for screwing with a hose, the drainage and the sewage treatment system being combined in one; said drainage being lower than the tabletop.

Said platen is of the same length as the tabletop and is higher than the tabletop.

Said tabletop is disposed thereunder with a rack for holding miscellaneous objects that is detachably mounted on the supports, in which a crossbar is centrally disposed, the crossbar being fixedly provided thereon with a bayonet that locks the rack for holding miscellaneous objects after folding the entire set of stove, a fastening means for the rack for holding miscellaneous objects which fastens the rack for holding miscellaneous objects to the crossbar after folding the entire set of stove being disposed on the other side with respect to the bayonet; a fastening means for the supports which fastens the disassembled supports being disposed below the tabletop.

After the entire set of stove is completely folded, caster assemblies can be inserted into the sockets on the other side with respect to said armrest, the caster assembly comprising a rubber tire and a caster tube, the rubber tire being fixedly provided thereon with an axle, the axle passing through the axle hole on one end of the caster tube and being fastened by a nut, and a caster tube insert that matches the socket being disposed on the other end of the caster tube.

The sewage discharged from said sewage treatment system is fed into an independent sewage treatment system for further treatment, the independent sewage treatment system comprising a housing body with an upper opening, a housing aperture whose size matches the size of an internally threaded and an externally threaded fitting being disposed on the wall of the housing body, the internally threaded fitting connected with a water pipe and the externally threaded fitting connected with a water pipe being threadedly jointed at the housing aperture.

Said left and right shields and said rear shield are connected with said rims through steel snap fasteners. An inserting plate is provided with a keyhole-shaped aperture for the snap engagement.

A steel plate is fixed among the supports of said single burner kitchen stove and is provided at the center thereof with a hole in which a liquefied gas cylinder can be placed.

A heat shield is disposed at the bottom of the burners of said single burner and double burner kitchen stoves.

The beneficial effects of the portable and easy-to-clean kitchen stove according to the present invention are simply structured, foldable, portable, sanitary, quickly assembled and suitable for use at home and outdoors.

DETAILED DESCRIPTION OF THE PREFERRED EMBODIMENTS

Figure 1:
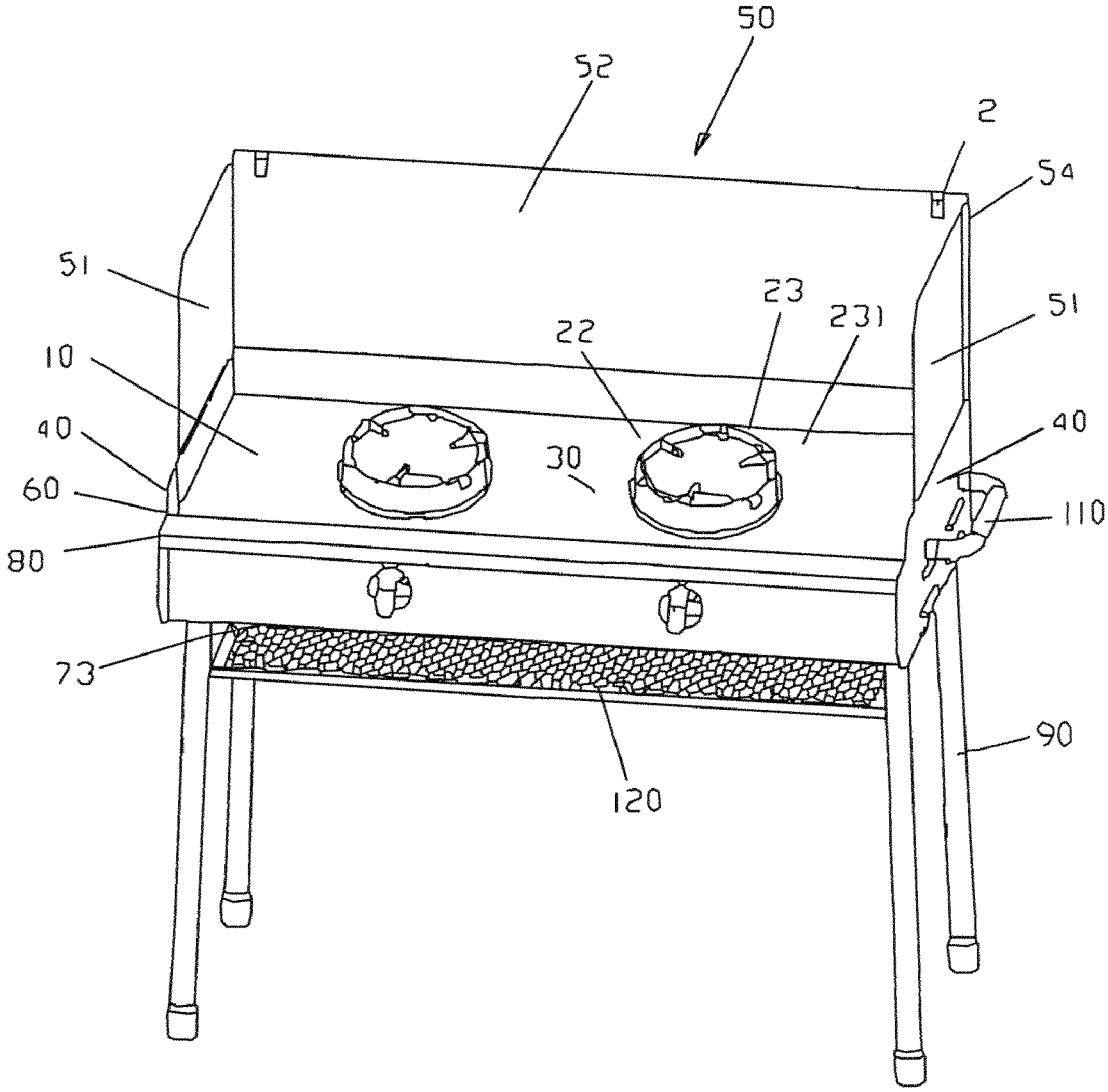
FIG. 1 is a schematic view showing a structure of a double burner kitchen stove according to the present invention.
Figure 2:
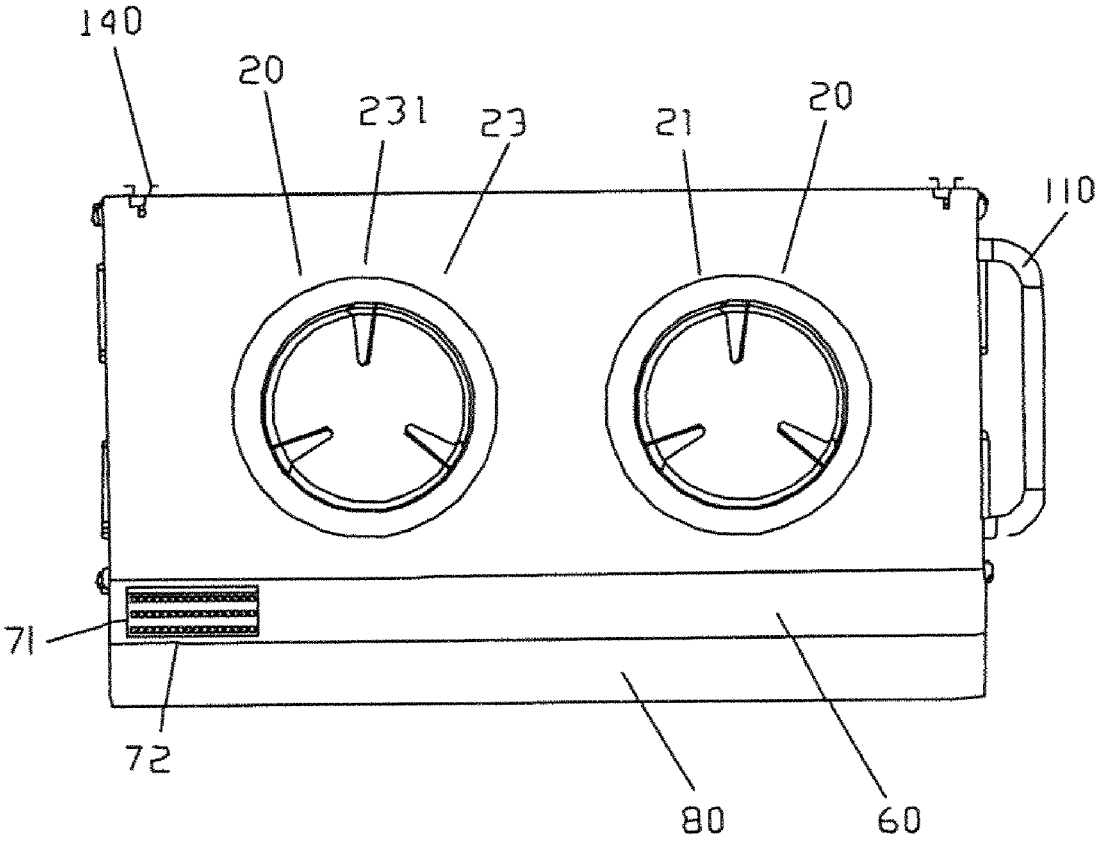
FIG. 2 is a top view of FIG. 1.
Figure 3:
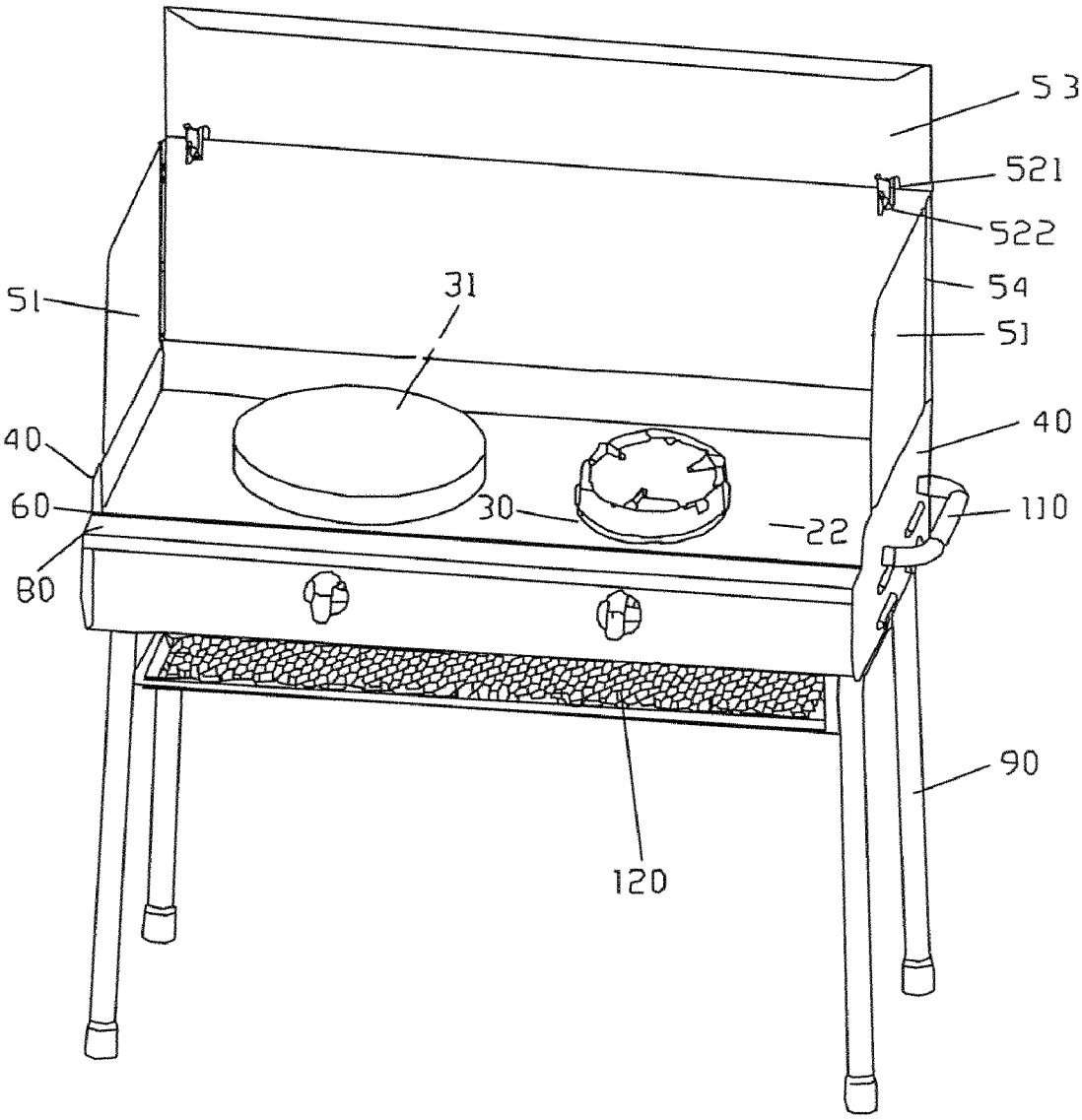
FIG. 3 is a schematic view of FIG. 1 with an extended steel face and a circular cover.
Figure 4:
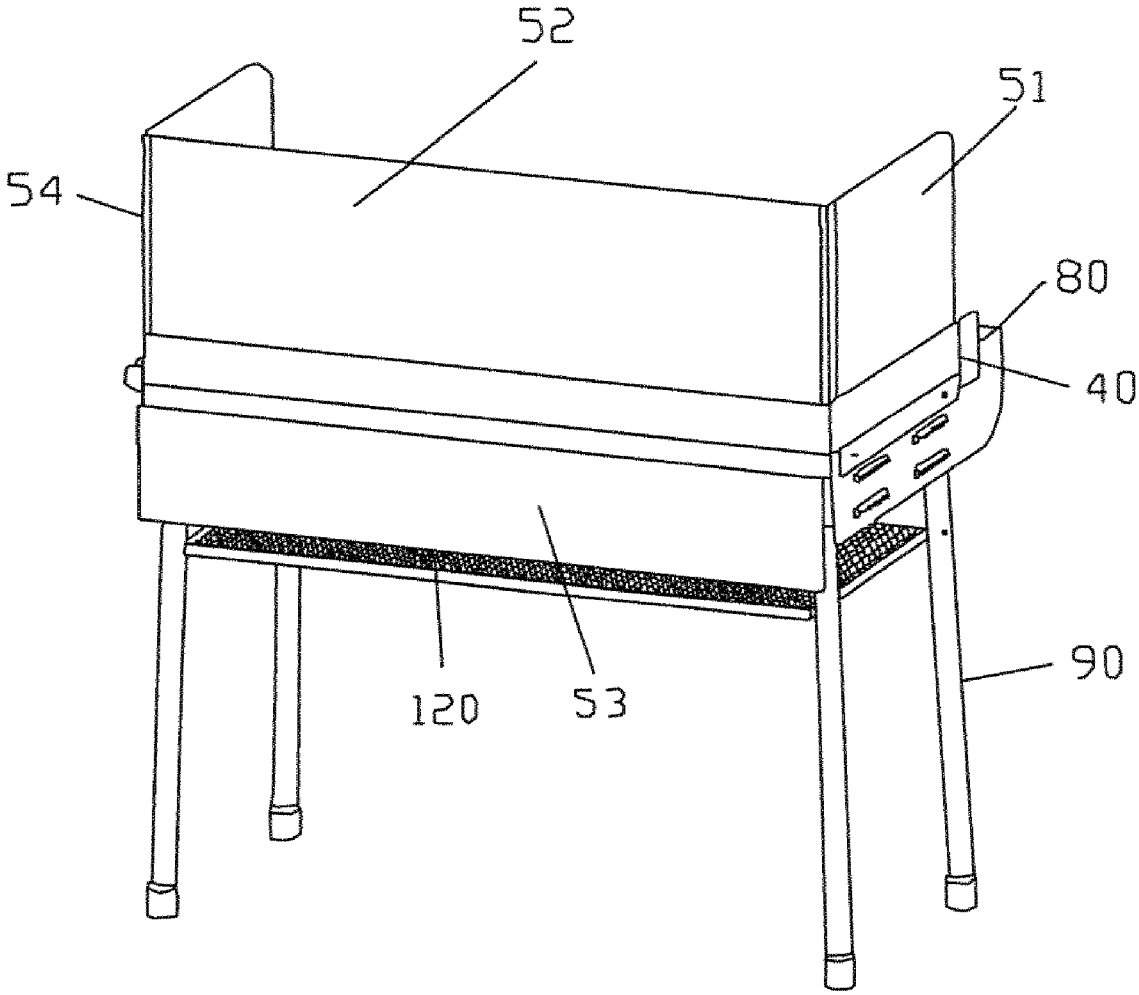
FIG. 4 is a schematic view of the rear of FIG. 1.
Figure 5:
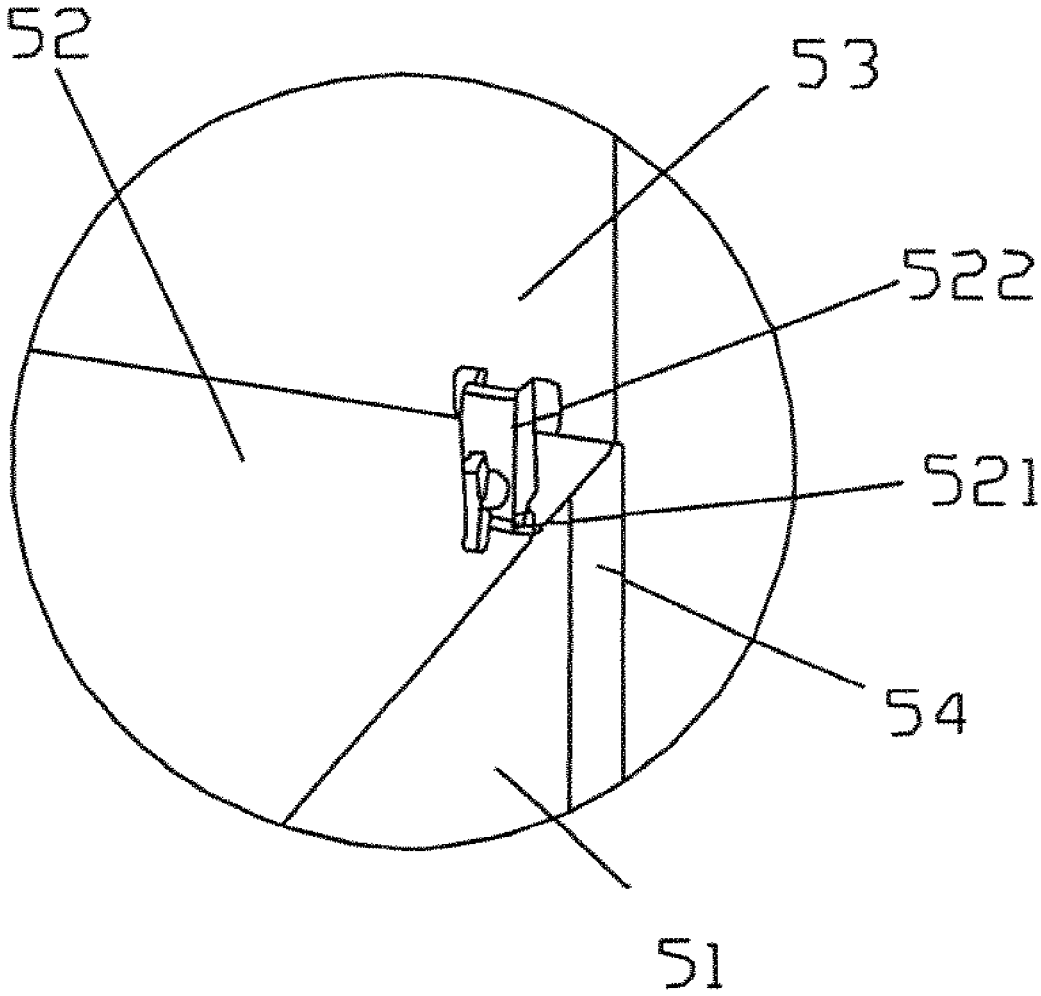
FIG. 5 is a partial enlarged schematic view showing a shield of FIG. 1.
Figure 6:
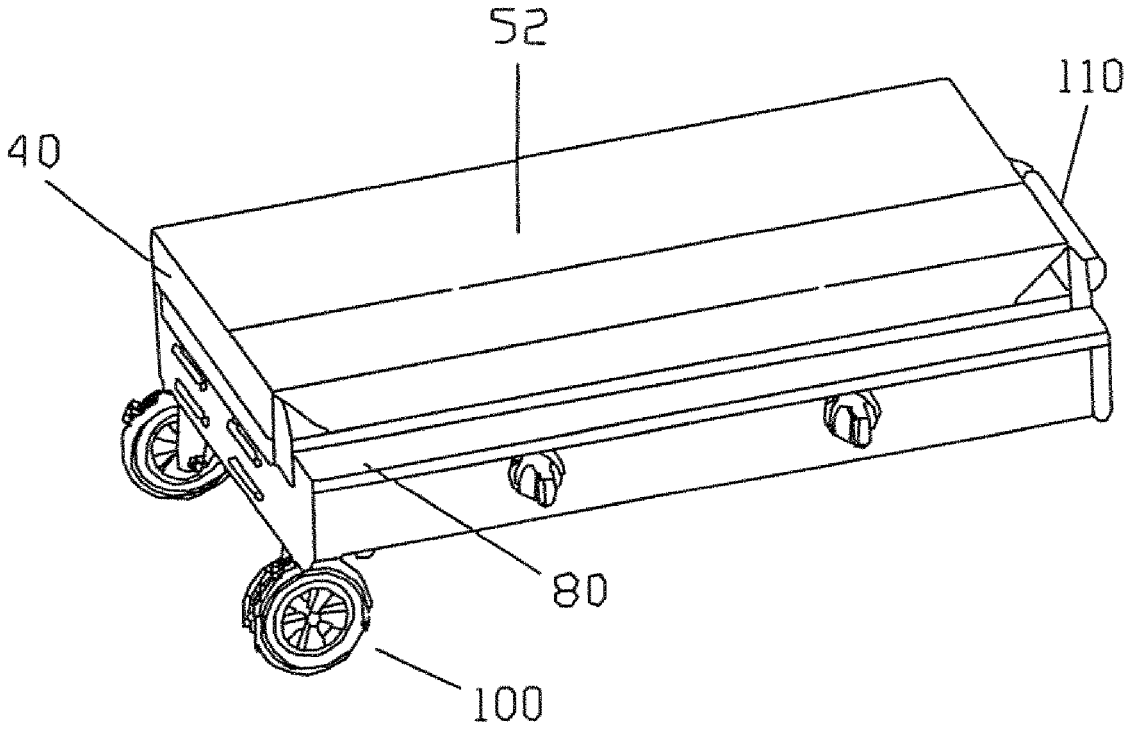
FIG. 6 is a schematic folded view of FIG. 1.
Figure 7:
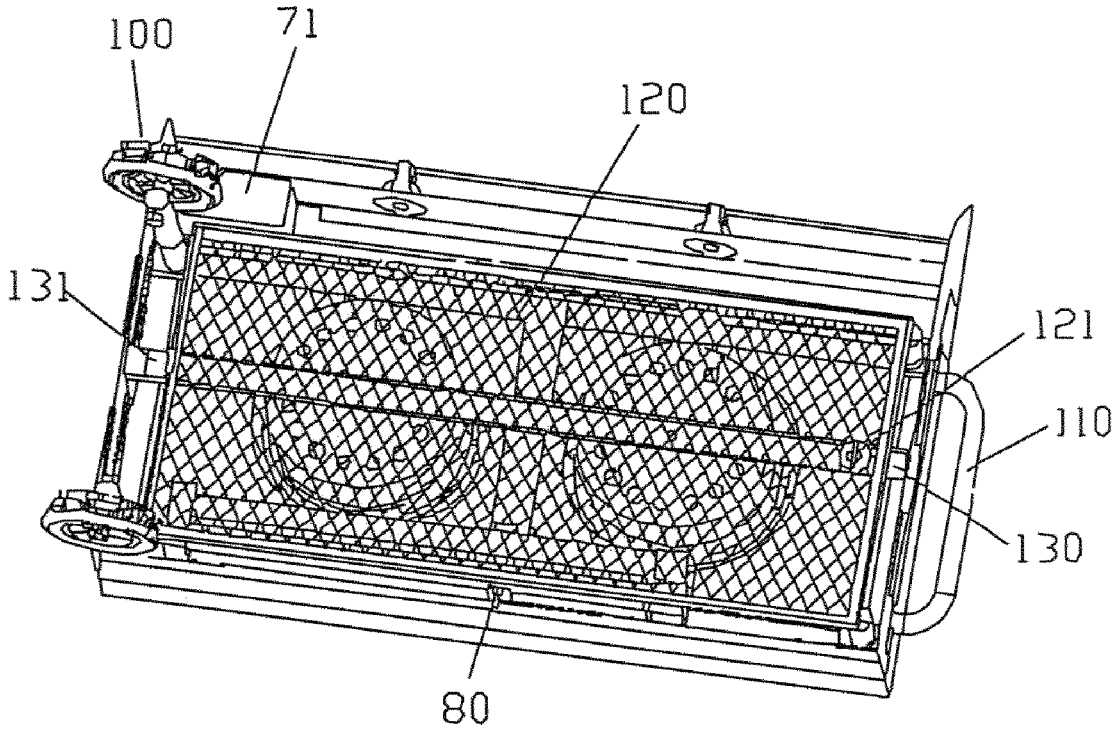
FIG. 7 is a schematic view of FIG. 1 after folded and turned over.
Figure 8:
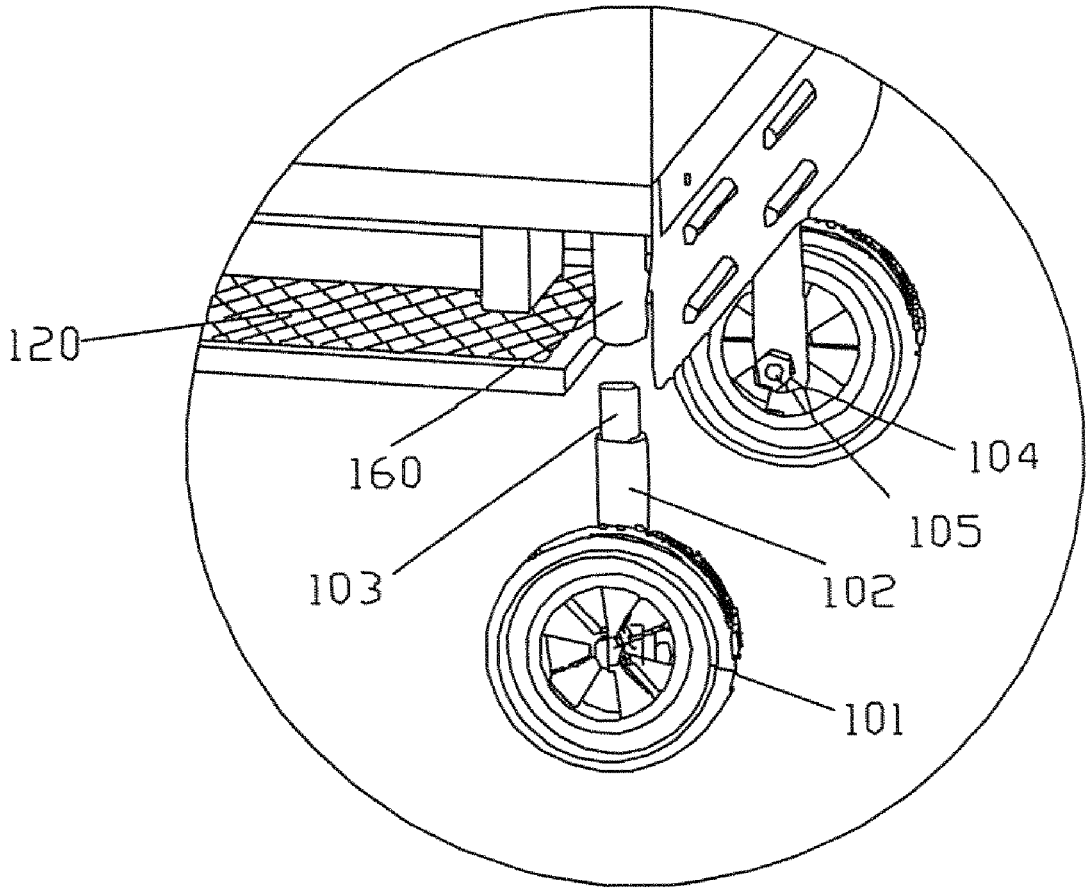
FIG. 8 is a schematic view showing a caster assembly of FIG. 1.
Figure 9:
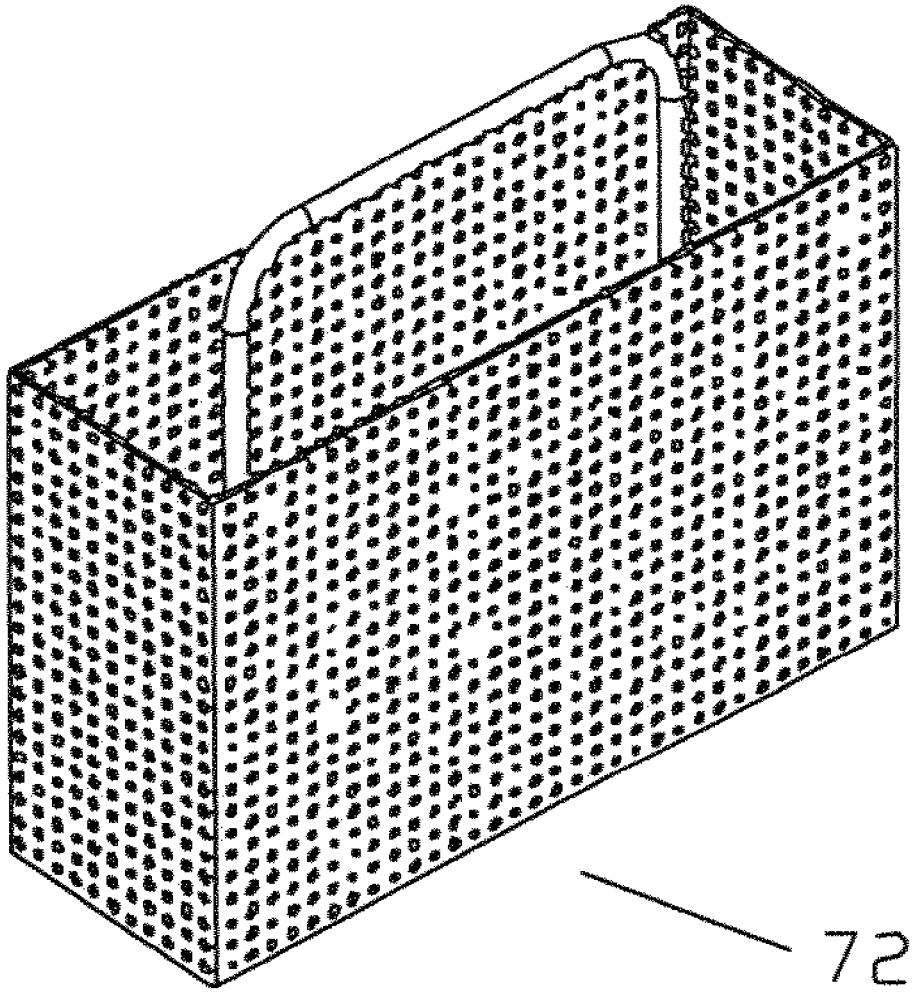
FIG. 9 is a schematic view showing a waste collection box test of FIG. 1.
Figure 10:
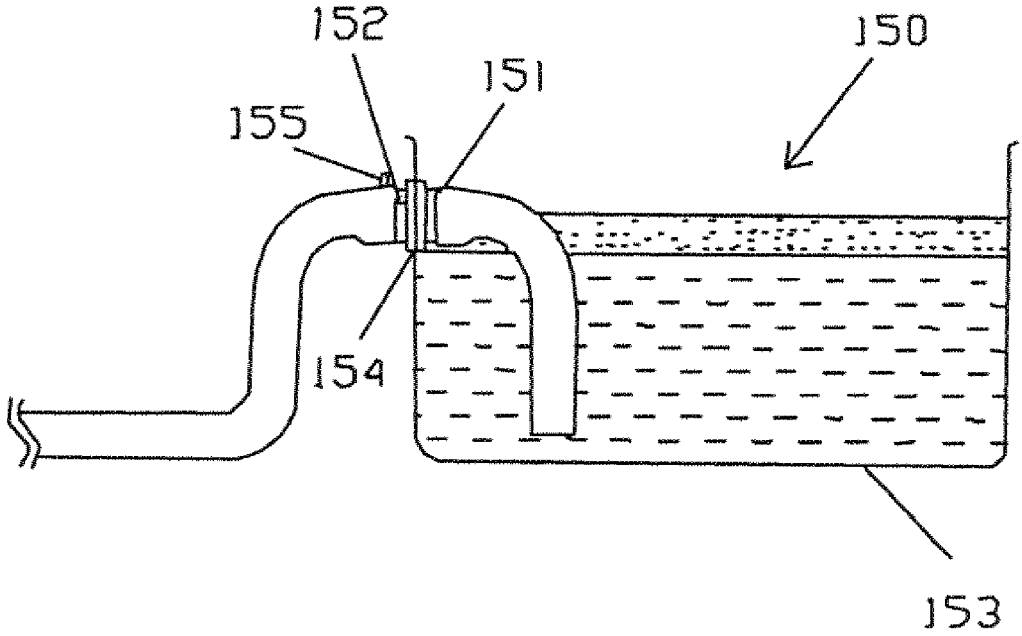
FIG. 10 is a schematic view showing an independent sewage treatment system of FIG. 1.

Referring to FIGS. 1 to 6, the present invention is implemented by:

A portable and easy-to-clean kitchen stove including a single burner kitchen stove and a double burner kitchen stove that includes in its structure a tabletop (10) and supports (90), the tabletop (10) being provided thereon with circular burner openings (21), burners (20) being installed at the bottommost of the burner openings (21), chimney-shaped thermo-protective devices (22) and pan adapters (23) being arranged above the burners (20) in turn, the burner openings (21) being circumferentially welded with baffle rings (30), the baffle rings (30) being provided therein with stove rings (234), the pan adapters (23) being arranged above the stove rings (234), a circular cover (31) detachably covering the baffle ring (30), the rear, left and right edges of the tabletop (10) being fixedly connected with rims (40) and flexibly connected with a shield (50) from the outside to the inside thereof in turn, a drainage (60) being disposed in front of the burner openings (21) on the tabletop (10), the end of the drainage (60) being provided with a separator, a platen (80) being disposed between the drainage (60) and the front edge of the tabletop (10), and the supports (90) that are attachable/detachable and rotatable to be folded in being installed under the tabletop (10) Sockets (160) for assembling and disassembling the supports (90) are arranged beneath the tabletop (10), and one side of the tabletop (10) is provided with an armrest (110).

A portable and easy-to-clean kitchen stove according to the present invention, in which the burner (20) portion is designed as a two-burner type, uses petroleum gas in combustion with output up to 75000 BTU.

According to a portable and easy-to-clean kitchen stove of the present invention, the aperture diameter of said chimney-shaped thermo-protective device (22) installed above the burner (20) is less than that of the burner opening (21), its bottom being horizontally aligned with the burner (20), 80% of its top portion being of concavo-convex design, 20% of its top portion being sealed, the sealed portion of the 20% preventing the flame from burning to the cook when cooking, its top portion being of the same height as the baffle ring (30) but the concavo-convex portion being higher than the baffle ring (30). The concavo-convex portion is designed with one-inch square and has the function that the flame can escape from the concave portion when cooking. The bottom of the thermo-protective device (22) is open type through which air can convect, and the concavo-convex portion is higher than the baffle ring (30) such that the deformation of tabletop (10) by heat can be reduced.

The thermo-protective devices (22) of the burners (20) are only suited to round-bottom woks, so according to a portable and easy-to-clean kitchen stove of the present invention, the thermo-protective devices (22) on the burners (20) are provided thereon with the pan adapters (23). The pan adapter (23) includes a supporting ring (231) and three legs (232) are uniformly arranged around the circumference of the supporting ring (231). One surface of the leg (232) is a plane surface, the other surface thereof is a beveled surface, and a raised firescreen (233) is further provided on the supporting ring (231). The beveled surfaces are used for round-bottom woks and the plane surfaces are used for flat bottom pans. A positioning groove (235) is provided on the circumference of the stove ring (234). The adapter (23) is caught and fixed in the positioning groove (235) of the stove ring (234) through the legs (232).

The baffle rings (30) welded on the periphery of the burner openings (21) function to prevent the water from flowing inwardly into the burners (20) during cooking. A circular cover (31) detachably covers the baffle ring (30), and the circular cover (31) fits the burner opening (21) and has the function that when cleaning the tabletop (10), the circular cover (31) made of stainless steel covers the burner opening (21) so as to protect the burner (20) against both water flooding and rain.

The rims (40) fixedly connected with the rear, left and right edges of the tabletop (10) can prevent the sewage from overflowing outwardly.

According to a portable and easy-to-clean kitchen stove of the present invention, the shield (50) is comprised of a left and a right shield (51), a rear shield (52) and two steel angles (54), the left and the right shield (51) being connected to the left and the right side of the rear shield (52) by hinges, the left and the right shield (51) being inwardly rotatable so as to overlap the rear shield (52); the bottom of the rear shield (52) being fastened to the rim (40) at the rear by hinges, the rear shield (52) being forwardly rotatable so as to be superposed on the left and the right shield (51) and be placed on the tabletop (10), thereby having high portability and reducing the damage to the kitchen stove from adverse environments; the left and the right side of the rear shield (52) each having one steel angle (54), thereby preventing water from flowing out of the tabletop (10) through the hinges that connect the left and the right shield (51) and the rear shield (52) as well as steel angles (54) allowing the shield (50) to be difficulty deformed when the three-plate shield (50) being folded and placed on the tabletop (10); the rear shield (52) and the steel angles (54) being of integral construction or being welded. The shield (50) has the functions described as follows: (1) a cooking process can be protected from the influence of external air flow; (2) the fried sauces and materials leaped out of a frying pan during cooking only remain inside the shield (50) and on the tabletop (10); (3) it can be jet cleaned with a hose after cooking is finished, and the shield (50) enables the sewage to return to the tabletop (10) into the drainage (60); (4) High heat dissipation during cooking that would cause danger can be prevented. Said rear shield (52) is detachably snap-fitted with an extended steel face (53), the extended steel face (53) being bilaterally fixedly provided there on with bearing bolts (522) that match the bearing sleeves (521) disposed on the rear shield (52), which has the functions of aesthetics and rain proofness. When the extended steel face (53) is off use, it can be hung on the hooks (140) of the lower portion of the rim (40) at the rear by the bearing sleeves (521).

The separator located on the end of the drainage (60) is divided into a detachable waste collection box (72) and a sewage treatment system (71), the detachable waste collection box (72) being a box with many small apertures and fully open on the top side, when waste together with sewage passing through the detachable waste collection box, the sewage outflowing through the small apertures and the waste being left in the box, whereby it is only necessary to take out the detachable waste collection box for dumping the trash each time cooking and cleaning are completed; the sewage treatment system (71) being a rectangular box connected to the end of the drainage (60), its bottom being provided with a circular opening connected with a round stainless steel tube (73), the round steel tube (73) being provided thereon with threads for screwing with a hose, and the round steel tube (73) having the function to discharge the sewage. The drainage (60) and the sewage treatment system (71) are combined in one, and finally all the sewage is discharged out through the round steel tube (73).

The drainage (60) is lower than the tabletop (10) with an appropriate width and functions to enable the sewage, trash and steamed rice grains resulted from cooking to flow with the sewage into the drainage for further treatment.

According to a portable and easy-to-clean kitchen stove of the present invention, the platen (80) is of the same length as the tabletop (10) and is higher than the tabletop (10) and has the function that when the water flow on the tabletop (10) has too much impact force, the water flushed into the drainage (60) will not flush from the drainage (60) and flow onto the ground. Moreover, the cook can place the tools and towels on the platen (80) during cooking, and the tool hygiene will not be affected by the sewage and trash on the tabletop (10).

Said tabletop (10) is disposed thereunder with a rack (120) for holding miscellaneous objects such as cookers and the like that is detachably mounted on the supports (90), in which a crossbar (130) is centrally disposed, the crossbar (130) being fixedly provided thereon with a bayonet (131) that locks the rack (120) for holding miscellaneous objects after folding the entire set of easy-to-clean kitchen stove, a fastening means (121) for the rack (120) for holding miscellaneous objects which fastens the rack (120) for holding miscellaneous objects to the crossbar (130) after folding the easy-to-clean kitchen stove being disposed on the other side with respect to the bayonet (131), multiple means being able to be used as the fastening means (121) for the rack (120) for holding miscellaneous objects, a turn-lock closure being used in the present invention; a fastening means for the supports which fastens the disassembled supports (90) being disposed below the tabletop (10). The disassembled rack for holding miscellaneous objects and disassembled supports are fastened to the bottom of the tabletop, thereby reducing the volume of the stove to enable high portability.

After the easy-to-clean kitchen stove is folded, caster assemblies (100) can be inserted into the sockets (160) on the other side with respect to said armrest (110) such that it is convenient to move the stove, for example, to haul the stove as long as the armrest is pulled by hand; the caster assembly (100) comprising a rubber tire (101) and a caster tube (102), the rubber tire (101) being fixedly provided thereon with an axle (105), the axle (105) passing through the axle hole on one end of the caster tube (102) and being fastened by a nut (104), and a caster tube insert (103) that matches the socket (160) being disposed on the other end of the caster tube (102).

The sewage discharged from said sewage treatment system (71) is fed into an independent sewage treatment system (150) for further treatment, the independent sewage treatment system (150) comprising a housing body (153) with an upper opening, a housing aperture (154) whose size matches the size of an internally threaded and an externally threaded fitting (151, 152) being disposed on the upper portion of the wall of the housing body (153), the internally threaded fitting (151) connected with a water pipe and the externally threaded fitting (152) connected with a water pipe being threadedly jointed at the housing aperture (154), the water pipe inside the housing being at a certain distance from the bottom of the housing, and a vent (155) being disposed on the top of the effluent pipe outside the housing. For the most part, after the sewage flows into the independent sewage treatment system (150), the contaminated water is drawn from the bottom of the system by means of the properties of water and oil, and then contaminated oil is removed. When there is water in the housing, the water pipe inside the housing stores the water automatically because the outside water pipe has the vent to discharge gas. When the interface between the water and oil in the housing reaches the bottom position or middle position of the highest level of the water pipe, the water in the housing automatically overflows through the outside pipe and the delivery head of the water pipe outside the housing is lower than the housing.

Figure 11:
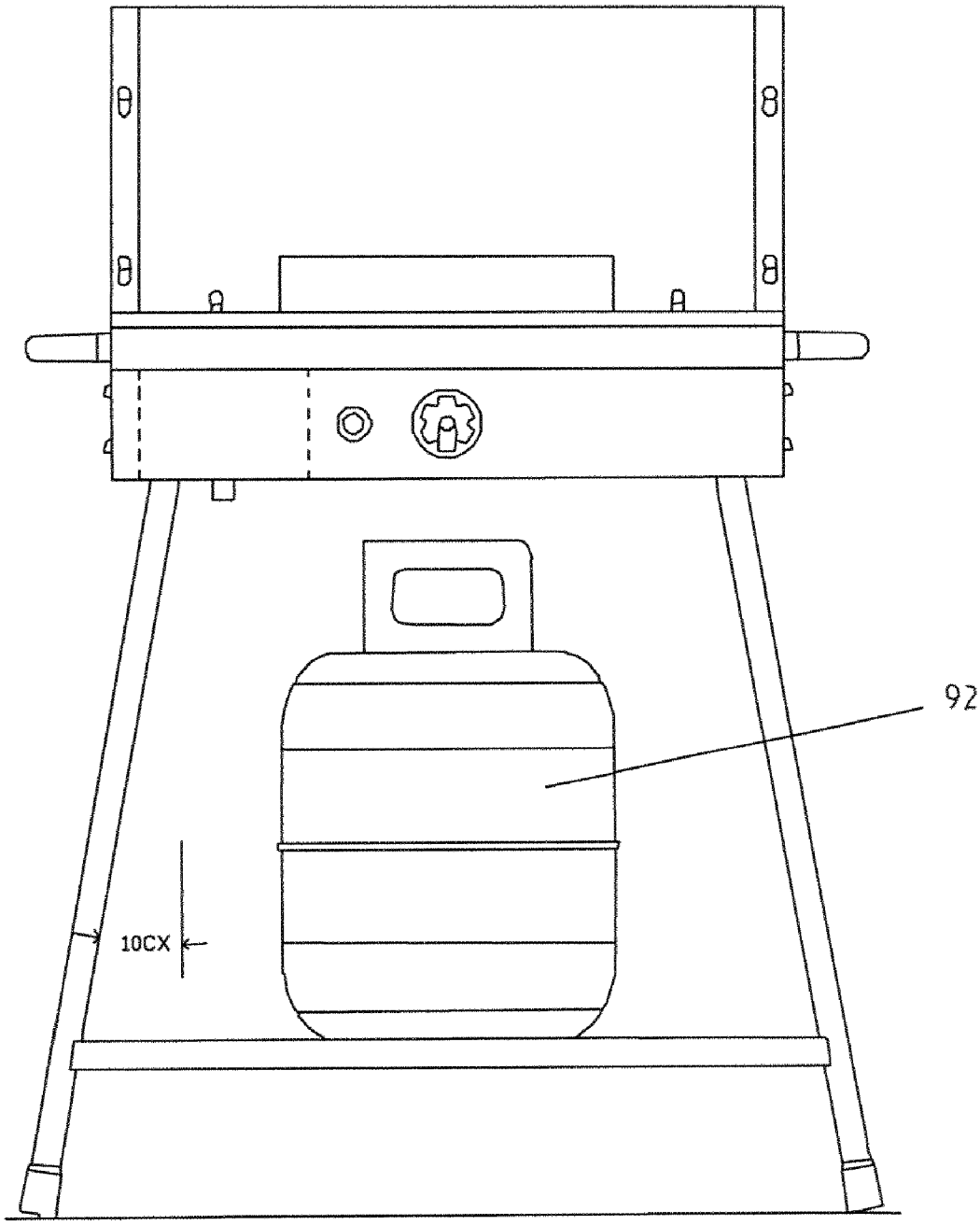
FIG. 11 is a schematic view showing a structure of a single burner kitchen stove according to the present invention.
Figure 12:
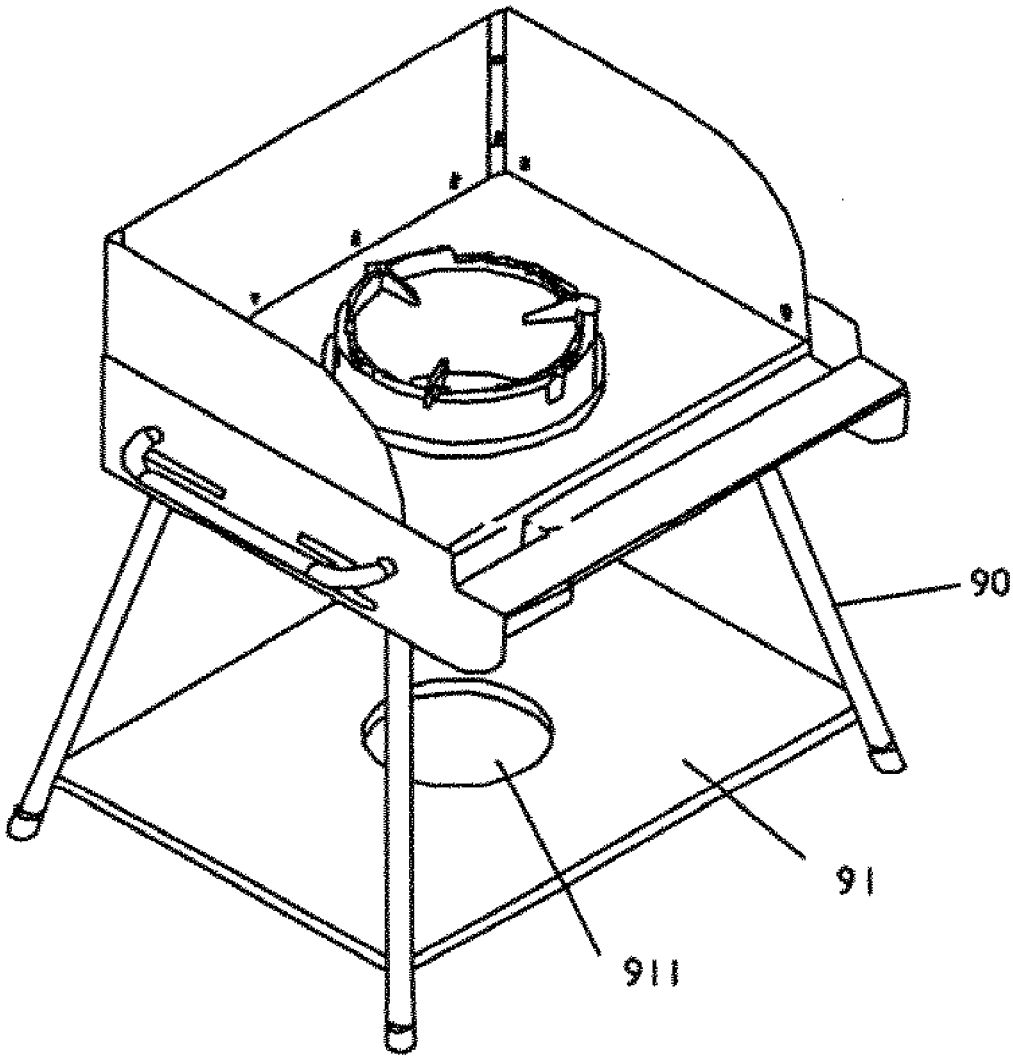
FIG. 12 is a three-dimensional view of FIG. 11, in which no liquefied gas cylinder exists.
Figure 13:
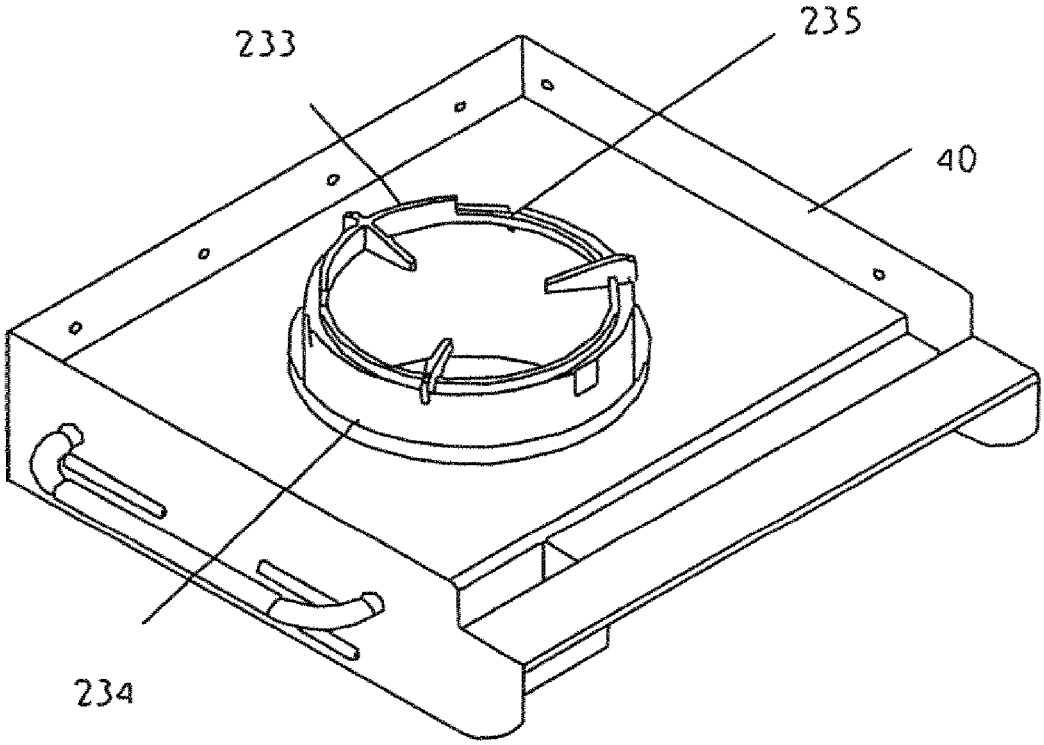
FIG. 13 is a schematic view showing an upper structure of FIG. 11, which represents rims surrounding the stove.
Figure 14:
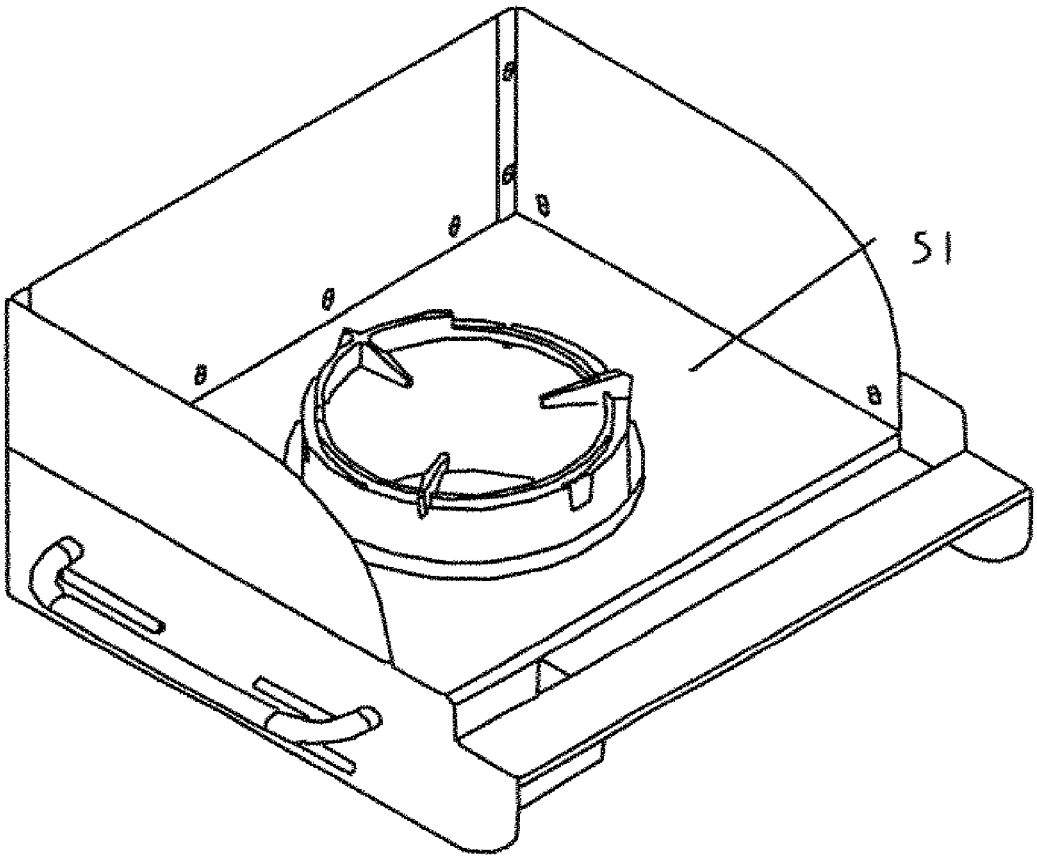
FIG. 14 is a schematic view showing an upper structure of FIG. 11, which represents three shields surrounding the stove.
Figure 15:
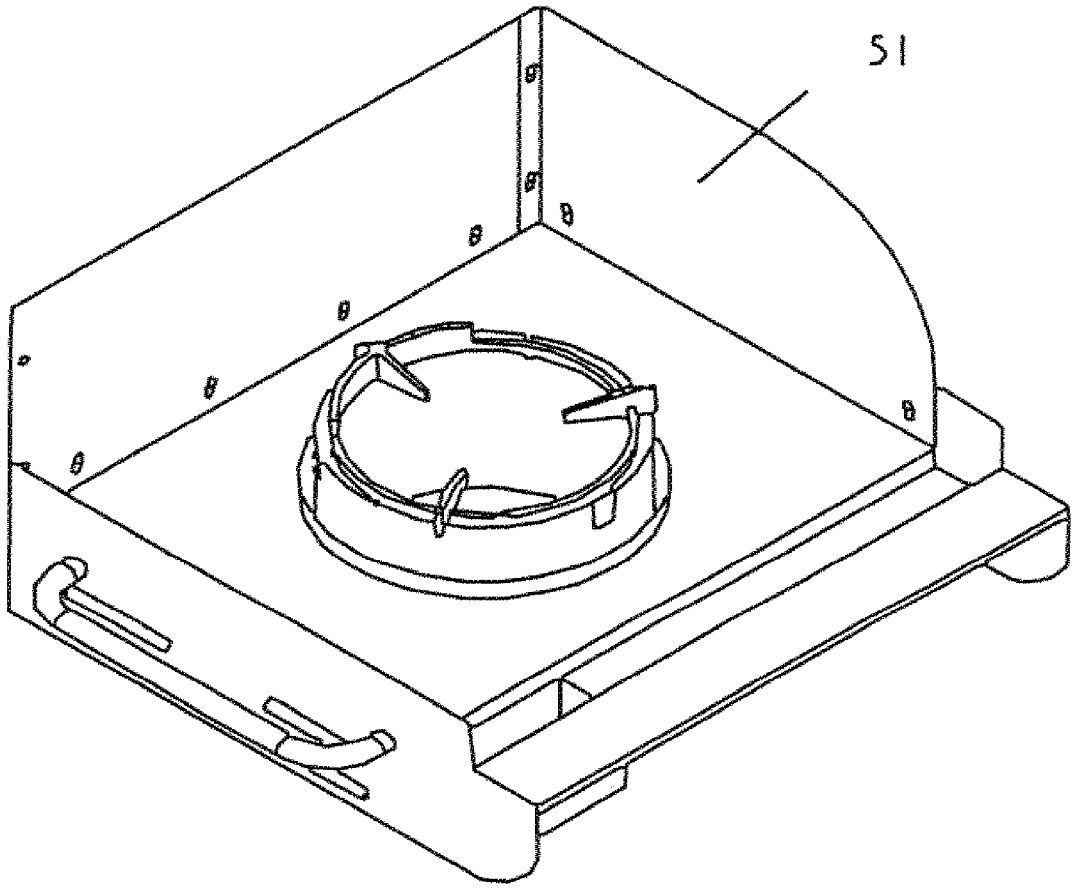
FIG. 15 is a schematic view showing an upper structure of FIG. 11, which represents two shields surrounding the stove.
Figure 16:
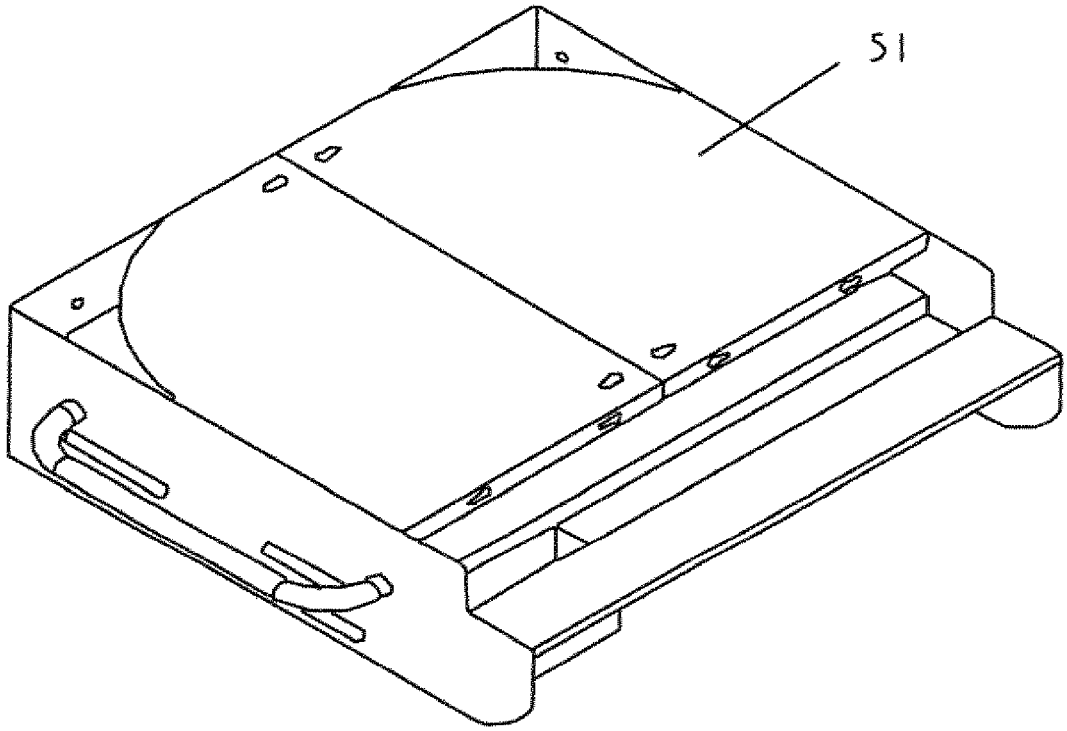
FIG. 16 is a schematic view showing an upper structure of FIG. 11, which represents shields in a folded state.

FIGS. 11 to 16 show a structure of a single burner kitchen stove according to the present invention, which can be referenced by the structure of the double burner kitchen stove.

The preferred embodiments aforementioned are just for the purpose of illustrating the portable and easy-to-clean kitchen stove according to the present invention and not meant to limit the scope of the present invention. Any alteration, equivalent variation and modification made according to technical contents of the present invention are still covered by the scope of present invention.

I claim:

1. A portable and easy-to-clean kitchen stove including a tabletop and supports, wherein the tabletop is provided thereon with circular burner openings, at least a burner being installed at the bottommost of the burner openings, chimney-shaped thermo-protective devices and pan adapters being arranged above the burner in turn, the burner openings being circumferentially welded with baffle rings, the baffle rings being provided therein with stove rings, the pan adapters being arranged above the stove rings, a circular cover detachably covering the baffle ring, the rear, left and right edges of the tabletop being fixedly connected with rims and flexibly connected with a shield from the outside to the inside thereof in turn, a drainage being disposed in front of the burner openings on the tabletop, the end of the drainage being provided with a separator, a platen being disposed between the drainage and the front edge of the tabletop, sockets for assembling and disassembling the supports being arranged beneath the tabletop, and one side of the tabletop being provided with an armrest.

2. The portable and easy-to-clean kitchen stove as described in claim 1, wherein the aperture diameter of said chimney-shaped thermo-protective device installed above the burner is less than that of the burner opening, the bottom of said chimney-shaped thermo-protective device being horizontally aligned with the burner, a first part of the top portion of said chimney-shaped thermo-protective device being of concavo-convex design, a second part of the top portion being sealed, the top portion being of the same height as the baffle ring but the concavo-convex portion being higher than the baffle ring.

3. The portable and easy-to-clean kitchen stove as described in claim 1, wherein said pan adapter includes a supporting ring, three legs being uniformly arranged around the circumference of the supporting ring, one surface of the leg being a plane surface, the other surface thereof being a beveled surface, and a raised firescreen being further provided on the supporting ring.

4. The portable and easy-to-clean kitchen stove as described in claim 1, wherein a circular cover detachably covers said baffle ring and the circular cover fits the burner opening.

5. The portable and easy-to-clean kitchen stove as described in claim 1, wherein said shield is comprised of a left and a right shield, a rear shield and two steel angles, the left and the right shield being connected to the left and the right side of the rear shield by hinges, the left and the right shield being inwardly rotatable so as to overlap the rear shield; the bottom of the rear shield being fastened to the rim at the rear by hinges, the rear shield being forwardly rotatable so as to be superposed on the left and the right shield and be placed on the tabletop, the two sides of the rear shield each having one steel angle, the rear shield and the steel angles being of integral construction or being welded; said rear shield being detachably snap-fitted with an extended steel face, the extended steel face being bilaterally fixedly provided thereon with bearing bolts that match the bearing sleeves disposed on the rear shield; the extended steel face being hangable on the hooks of the lower portion of the rim at the rear by the bearing sleeves.

6. The portable and easy-to-clean kitchen stove as described in claim 5, wherein said left and right shields and said rear shield are connected with said rims through steel snap fasteners.

7. The portable and easy-to-clean kitchen stove as described in claim 1, wherein said separator is divided into a detachable waste collection box and a sewage treatment system, the detachable waste collection box being a box with many small apertures and fully open on the top side, the sewage treatment system being a rectangular box connected to the end of the drainage, the bottom of the rectangular box being provided with a circular opening connected with a round stainless steel tube, the round steel tube being provided thereon with threads for screwing with a hose, the drainage and the sewage treatment system being combined in one; said drainage being lower than the tabletop.

8. The portable and easy-to-clean kitchen stove as described in claim 7, wherein the sewage discharged from said sewage treatment system is fed into an independent sewage treatment system for further treatment, the independent sewage treatment system comprising a housing body with an upper opening, a housing aperture whose size matches the size of an internally threaded and an externally threaded fitting being disposed on the upper portion of the wall of the housing body, the internally threaded fitting connected with a water pipe and the externally threaded fitting connected with a water pipe being threadedly jointed at the housing aperture, the water pipe inside the housing being at a certain distance from the bottom of the housing, and a vent being disposed on the top of the effluent pipe outside the housing.

9. The portable and easy-to-clean kitchen stove as described in claim 1, wherein said platen is of the same length as the tabletop and is higher than the tabletop.

10. The portable and easy-to-clean kitchen stove, as described in claim 1, wherein said tabletop is disposed thereunder with a rack for holding miscellaneous objects that is detachably mounted on the supports, in which a crossbar is centrally disposed, the crossbar being fixedly provided thereon with a bayonet that locks the rack for holding miscellaneous objects after folding the entire set of easy-to-clean kitchen stove, a fastening means for the rack for holding miscellaneous objects which fastens the rack for holding miscellaneous objects to the crossbar after folding the easy-to-clean kitchen stove being disposed on the other side with respect to the bayonet; a fastening means for the supports which fastens the folded supports being disposed below the tabletop.

11. The portable and easy-to-clean kitchen stove as described in claim 1, wherein after the easy-to-clean kitchen stove is folded, caster assemblies are insertable into the sockets on the other side with respect to said armrest, the caster assembly comprising a rubber tire and a caster tube, is the rubber tire being fixedly provided thereon with an axle, the axle passing through the axle hole on one end of the caster tube and being fastened by a nut, and a caster tube insert that matches the socket being disposed on the other end of the caster tube.

12. The portable and easy-to-clean kitchen stove as described in claim 1, wherein a steel plate is fixed among the supports of said single burner kitchen stove and is provided at the center thereof with a hole in which a liquefied gas cylinder is placed.

13. The portable and easy-to-clean kitchen stove as described in claim 1, wherein a heat shield is disposed at the bottom of said burners.

* * * * *